US010594063B2

(12) United States Patent
Saoya et al.

(10) Patent No.: US 10,594,063 B2
(45) Date of Patent: Mar. 17, 2020

(54) WATERPROOF CONNECTION STRUCTURE, CONNECTION STRUCTURE BODY, AND PARTITION MEMBER

(71) Applicants: FURUKAWA ELECTRIC CO., LTD., Tokyo (JP); FURUKAWA AUTOMOTIVE SYSTEMS INC., Shiga (JP)

(72) Inventors: Naoshi Saoya, Tokyo (JP); Masahiro Okumura, Tokyo (JP)

(73) Assignees: FURUKAWA ELECTRIC CO., LTD., Tokyo (JP); FURUKAWA AUTOMOTIVE SYSTEMS INC., Shiga (JP)

( * ) Notice: Subject to any disclaimer, the term of this patent is extended or adjusted under 35 U.S.C. 154(b) by 0 days.

(21) Appl. No.: 15/755,212

(22) PCT Filed: Aug. 30, 2016

(86) PCT No.: PCT/JP2016/075300
§ 371 (c)(1),
(2) Date: Feb. 26, 2018

(87) PCT Pub. No.: WO2017/043366
PCT Pub. Date: Mar. 16, 2017

(65) Prior Publication Data

US 2018/0248284 A1 Aug. 30, 2018

(30) Foreign Application Priority Data

Sep. 2, 2015 (JP) ..... 2015-172977

(51) Int. Cl.
*H01R 12/67* (2011.01)
*H01R 4/70* (2006.01)
(Continued)

(52) U.S. Cl.
CPC ..... *H01R 12/67* (2013.01); *H01B 3/28* (2013.01); *H01B 7/28* (2013.01); *H01R 4/70* (2013.01); *H01R 12/63* (2013.01); *H01R 13/5216* (2013.01)

(58) Field of Classification Search
CPC ..... H01R 12/68; H01R 12/69; H01R 13/52; H01R 13/521; H01R 33/965; H01R 4/70;
(Continued)

(56) References Cited

U.S. PATENT DOCUMENTS 5,061,202 A * 10/1991 Nemcovsky ..... H01R 23/661 439/404
2002/0127904 A1 9/2002 Aoki

FOREIGN PATENT DOCUMENTS

CN 203787601 U 8/2014
JP 2000058185 A * 2/2000
(Continued)

OTHER PUBLICATIONS

Machine Translation of Ito (JP H0765873A) provided with Office Action.*
(Continued)

*Primary Examiner* — Roshn K Varghese
(74) *Attorney, Agent, or Firm* — Oblon, McClelland, Maier & Neustadt, L.L.P.

(57) ABSTRACT

Object:
It is desirable to provide a waterproof connection structure, a connection structure body, and a partition member that can easily and reliably prevent water penetration.
Resolution Means:
The waterproof connecting portion (1A) of a connection structure body (1) includes an FFC (30) formed by sandwiching a plurality of flat conductors (41) arranged in parallel in a width direction in a sheet-like insulating cov-
(Continued)

ering, a plurality of insulated wires (40) each obtained by covering a conductor (41) with an insulating covering (42), a plurality of WF terminals (20) that are arranged in parallel in the width direction and connect the flat conductors (41) and the conductors (41), a terminal holder (10) that partitions the WF terminals (20) in an insulating manner, and a butyl sheet (50) that integrally covers the plurality of WF terminals (20) partitioned by the terminal holder (10) and the terminal holder (10), and has waterproofing properties, insulating properties, and stretching properties.

14 Claims, 12 Drawing Sheets

(51) Int. Cl.

| | |
|---|---|
| ***H01R 13/52*** | (2006.01) |
| ***H01R 12/63*** | (2011.01) |
| ***H01B 3/28*** | (2006.01) |
| ***H01B 7/28*** | (2006.01) |

(58) Field of Classification Search
CPC .... H01R 12/67; H01R 12/63; H01R 13/5216; H01R 13/5213; H01B 3/28; H01B 7/28
USPC ..... 439/404, 492, 494
See application file for complete search history.

(56) References Cited

FOREIGN PATENT DOCUMENTS

| | | | |
|---|---|---|---|
| JP | 2002-260761 | A | 9/2002 |
| JP | 2009-87853 | A | 4/2009 |
| JP | 2013-37902 | A | 2/2013 |

OTHER PUBLICATIONS

Original Ito (JP H0765873A) provided with Office Action.*
Machine translation of Komiyama (JP2000058185A) provided with Office Action (Year: 2000).*
International Search Report dated Nov. 22, 2016, in PCT/JP2016/075300, filed Aug. 30, 2016.
Korean Office Action dated Apr. 11, 2019 in Patent Application No. 10-2018-7005076 (with unedited computer generated English translation), 9 pages.
Office Action dated Nov. 29, 2018 in Chinese Patent Application No. 201680048599.3, with English-language translation, 19 pages.
Office Action dated Jul. 12, 2019 in Chinese Patent Application No. 201680048599.3 (with English translation).
Notice of Allownace dated Dec. 9, 2019 in Chinese Patent Application No. 201680048599.3, with English language translation, 5 pages.

* cited by examiner

PORTION a
PORTION a
10
1A
1
11
11, 12
11a, 12c
13
14
15
20
21
22
23
24
30
30a
40
41
42

WATERPROOF CONNECTION STRUCTURE, CONNECTION STRUCTURE BODY, AND PARTITION MEMBER

TECHNICAL FIELD

The present invention relates to a waterproof connection structure, a connection structure body, and a partition member capable of waterproofing a connection portion of a flat cable and an insulated wire, for example.

BACKGROUND

Generally, when a flat cable (hereinafter referred to as "flexible flat cable (FFC)") obtained by sandwiching a plurality of flat conductors arranged in parallel in a width direction in a sheet-like insulating covering and a plurality of insulated wires each obtained by covering a conductor with an insulating covering are connected, the conductor of each insulated wire is connected to each flat conductor of the flat cable via a connection terminal called a wire-to-FFC joint (WF) terminal.

Thus, for one FFC, the number of insulated wires and connection terminals needs to be the same as the number of flat conductors of the FFC, and the insulated wires and connection terminals are arranged in parallel in the width direction of the FFC.

A connection portion that uses such a connection terminal of the FFC and insulated wire requires waterproofing properties for preventing water penetration, for example. Patent Document 1, for example, proposes a structure in which connection terminals arranged in parallel in the width direction are arranged as a whole in a protective case that extends across an end portion of the FFC and an end portion of the insulated wire and has an open upper surface, and a sealing material serving as a filler is filled in the protective case.

However, such a connection structure with waterproofing properties requires materials and processes such as disposing the connection terminals in the protective case and filling the protective case with a sealing material such as a hot melt material, making the structure inadequate in terms of desires for further improving manufacturing efficiency and achieving reductions in cost.

PRIOR ART DOCUMENT

Patent Document

Patent Document 1: JP 2009-87853 A

SUMMARY OF THE INVENTION

Problems to be Solved by the Invention

Hence, it is desirable to provide a waterproof connection structure, a connection structure body, and a partition member capable of easily and reliably preventing water penetration.

Means to Solve the Problem

An aspect of this invention is a connection structure body that includes a flat cable formed by sandwiching a plurality of flat conductors arranged in parallel in a width direction in a sheet-like insulating covering, a plurality of insulated wires each obtained by covering a conductor with an insulating covering, a plurality of connection terminals that are arranged in parallel in the width direction and connect the flat conductors and the conductors, a partition member that partitions the connection terminals in an insulating manner, and a waterproof covering member that integrally covers the plurality of connection terminals partitioned by the partition member and the partition member, and has waterproofing properties, insulating properties, and stretching properties.

Or, another aspect of the present invention is a waterproof connection structure that includes a plurality of connection terminals that are arranged in parallel in a width direction and connect a plurality of flat conductors of a flat cable formed by sandwiching the flat conductors in a sheet-like insulating covering, the flat conductors being arranged in parallel in the width direction, and conductors of a plurality of insulated wires each obtained by covering one of the conductors with an insulating covering, a partition member that partitions the connection terminals in an insulating manner, and a waterproof covering member that integrally covers the plurality of connection terminals partitioned by the partition member and the partition member, and has waterproofing properties, insulating properties, and stretching properties. Still another aspect of the present invention is a partition member that is disposed between a plurality of connection terminals that are arranged in parallel in a width direction and connect a plurality of flat conductors of a flat cable formed by sandwiching the flat conductors in a sheet-like insulating covering, the flat conductor being arranged in parallel in the width direction, and conductors of a plurality of insulated wires each obtained by covering one of the conductors with an insulating covering, thereby partitioning the connection terminals in an insulating manner. The partition member includes a rod-like portion having a rod shape and insulating properties, outer frame portions disposed on outer sides of the plurality of connection terminals arranged in parallel, and a linking portion that links the rod-like portion and the outer frame portions on a first end side in a length direction of the rod-like portion.

The connection terminals described above are so-called WF terminals, and each includes an integrated terminal that makes a piercing connection with the flat conductor and a crimped connection with the conductor, or separate terminals that fit together and connect as a male and female coupling, one connecting to the flat conductor and another connecting to the conductor.

The waterproof covering member having waterproofing properties, insulating properties, and stretching properties includes a sheet-like member, a cover member, or the like made from a rubber, a silicon, or the like.

According to this invention, it is possible to easily and reliably waterproof the connection portion of a flat cable (FFC) and an insulated wire.

Specifically, while the connection terminals that connect the flat conductors of the FFC and the conductors of the insulated wires are arranged in parallel in the width direction, the partition member that partitions the connection terminals in an insulating manner is provided, making it possible to reliably connect the flat conductors and the conductors without the connection terminals inadvertently coming into contact and causing a short circuit. Note that the partition member is small in size compared to the protective case that houses the connection terminals and the like, for example, making it possible to compactly configure the connection portion and reduce part costs.

Further, the partition member and the plurality of connection terminals partitioned by the partition member are integrally covered by the waterproof covering member having waterproofing properties, insulating properties, and stretching properties, and thus, compared to a waterproof structure filled with a sealing material, it is possible to easily achieve at least the same level of waterproofing properties at low cost.

As a result, the waterproof connection structure and the connection structure body capable of reliably preventing water penetration can be achieved efficiently and at low cost.

As one aspect of this invention, the waterproof covering member may be pressurized onto the connection terminals and the partition member, thereby covering the connection terminals and the partition member.

This pressurization and covering refer to so-called pressure coating, meaning that the waterproof covering member is pressurized, thereby achieving a covering with improved adhesion of the contacting portion.

According to the aspect of this invention, it is possible to construct a connection structure having improved waterproofing properties.

As another aspect of this invention, the partition member may include a rod-like portion having a rod shape and insulating properties, outer frame portions disposed on outer sides of the plurality of connection terminals arranged in parallel, and a linking portion that links the rod-like portion and the outer frame portions on a first end side in a length direction of the rod-like portion.

According to the aspect of this invention, it is possible to construct a connection structure that prevents water penetration while reliably maintaining the positions of the connection terminals arranged in parallel in the width direction.

Specifically, when the arrangement of the plurality of terminals arranged in parallel deforms due to twisting or the like when covered with the waterproof covering member, for example, the possibility exists that the connection terminals will contact each other, causing a defect such as a short circuit, leading to deterioration of the waterproofing properties. The partition member, however, is formed from the rod-like portion having a rod shape and insulating properties, the outer frame portions disposed on the outer sides of the plurality of connection terminals arranged in parallel, and the linking portion that links the rod-like portion and the outer frame portions on the first end side in the length direction of the rod-like portion, making it possible to maintain the arrangement of the plurality of connection terminals even when covered by the waterproof covering member, and thus construct a connection structure that prevents water penetration while reliably maintaining the positions of the connection terminals arranged in parallel in the width direction.

As another aspect of this invention, the outer frame portions disposed on both outer sides of the plurality of connection terminals may be formed at different lengths.

According to the aspect of this invention, an assembly direction of the partition member can be visually checked, making it possible to construct the preferred connection structure without mistakes.

As another aspect of this invention, the first end side may be set as the side of the flat cable and a second end of the rod-like portion may be disposed near a second end side of the connection terminals.

According to the aspect of this invention, the linking portion is disposed on the flat cable side, making it possible to construct a compact connection structure. Further, the second end of the rod-like portion is disposed near the second end sides of the connection terminals, making it possible to prevent the possibility of the connection terminals on the side connected to independent insulated wires from inadvertently coming into contact and causing a short circuit or the like.

As another aspect of this invention, the linking portion may include an overlapping portion that overlaps with an end portion of the flat cable in a height direction.

According to the aspect of this invention, the relative positions in the height direction (thickness direction) of the flat cable and the partition member can be regulated, making it possible to construct a preferred connection structure without a shift in the height direction (thickness direction) of the flat cable and the partition member.

As another aspect of this invention, the linking portion may include a position regulating portion that regulates a position in the length direction with an end surface of the flat cable in contact in the length direction.

According to the aspect of this invention, the relative positions in the length direction of the FFC and the partition member can be regulated, making it possible to construct a preferred connection structure without a shift in the length direction of the FFC and the partition member.

As another aspect of this invention, a groove portion that allows the linking portion to be fitted therein may be provided between an end portion of the flat cable and the connection terminals, that is, the FFC side end portion of a box portion of the connection terminals.

According to the aspect of this invention, it is possible to regulate the relative positions in the length direction of the connection terminals and the partition member, and construct a compact connection structure to the extent that overlap of the box portion and the height of the groove portion is avoided.

As another aspect of this invention, a plurality of the rod-like portions may be provided.

According to the aspect of this invention, it is possible to construct a connection structure capable of reliably preventing water penetration without shorting the connection terminals, even when the FFC includes three or more flat conductors.

As another aspect of this invention, the connection structure body may be configured at about the same height as the connection terminals.

According to the aspect of this invention, it is possible to construct the connection structure having reliable waterproofing properties without producing unnecessary space on an inner side covered by the waterproof covering member and deteriorating the waterproofing properties.

As another aspect of this invention, each of the connection terminals may include a flat conductor connecting portion that connects with the flat conductor in a conducting manner, a conductor connecting portion that connects with the conductor in a conducting manner, and a box portion disposed between the flat conductor connecting portion and the conductor connecting portion, and the partition member may include a support portion that supports the box portion.

Each of the connection terminals that includes the flat conductor connecting portion that connects with the flat conductor in a conducting manner, the conductor connecting portion that connects with the conductor in a conducting manner, and the box portion disposed between the flat conductor connecting portion and the conductor connecting portion is a so-called WF terminal.

According to the aspect of this invention, the box portion having mechanical strength is supported by the support portion, making it possible to reliably maintain each of the connection terminals with respect to the partition member.

As another aspect of this invention, the waterproof covering member may be made from a rubber sheet material.

The rubber sheet material may be a sheet material made from various rubber, such as a butyl rubber, having a predetermined thickness.

According to the aspect of this invention, the waterproof covering member is made from a rubber sheet material such as a butyl rubber of a general base material having a stable, uniform quality, making it possible to easily construct a connection structure having stable waterproofing properties at low cost.

Effects of the Invention

According to this invention, it is possible to provide a waterproof connection structure, a connection structure body, and a partition member capable of easily and reliably preventing water penetration.

SUMMARY OF INVENTION

Technical Problem

An embodiment of the present invention will be described below with reference to the drawings.

Figure 1:
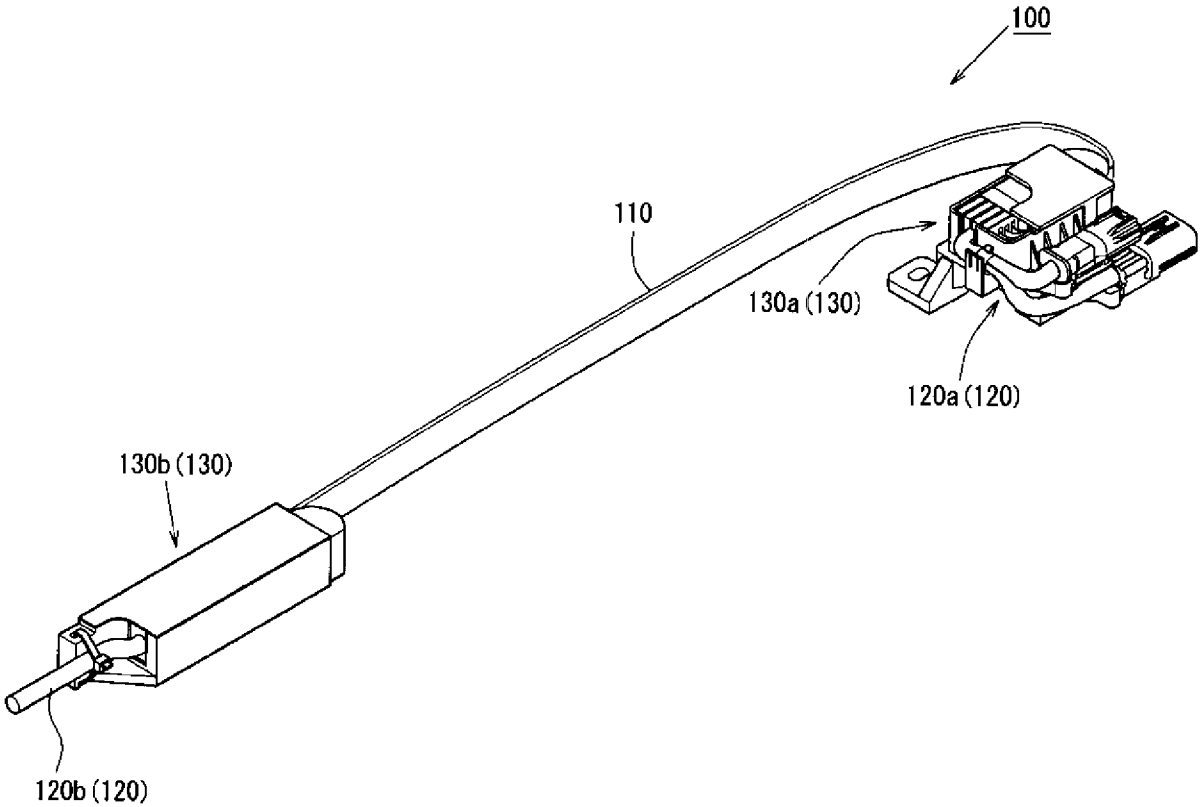
FIG. 1 illustrates a schematic perspective view of a wire assembly.
Figure 2A:
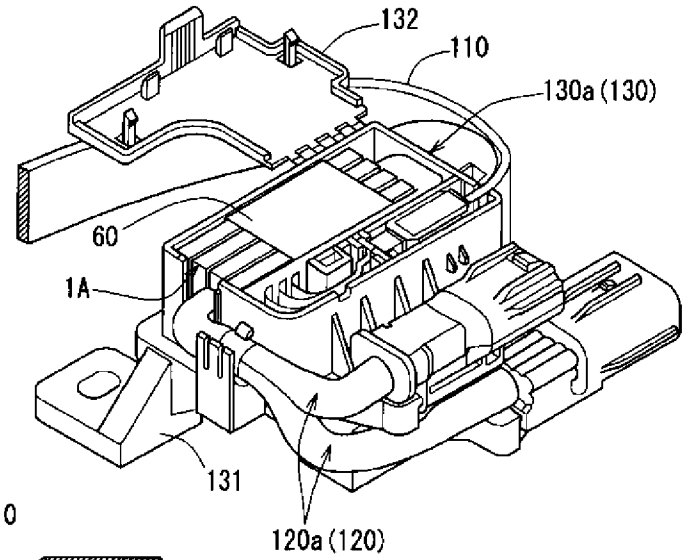
FIGS. 2A and 2B illustrate explanatory views of a holder.
Figure 2B:
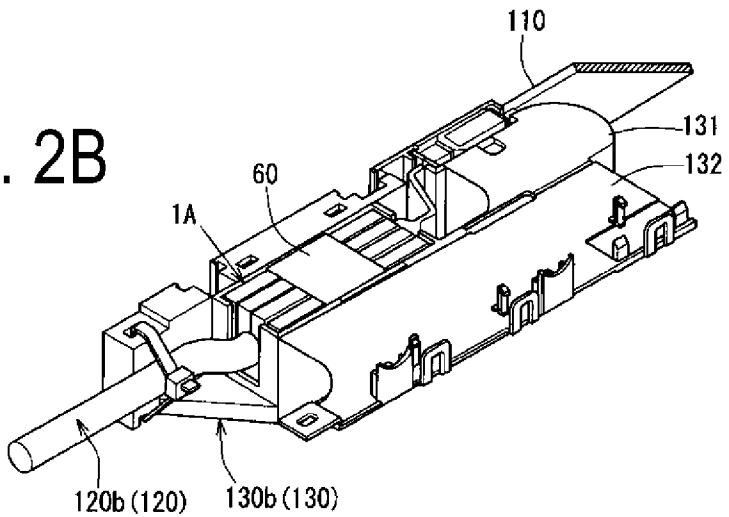
Figure 3A:
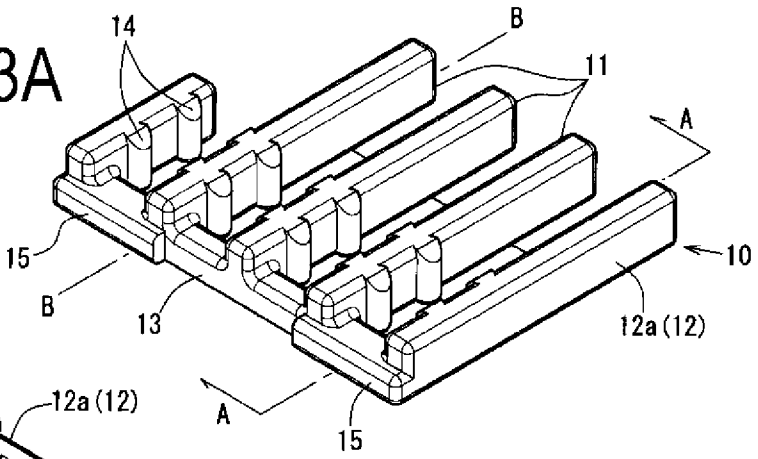
FIGS. 3A to 3C illustrate explanatory views of a terminal holder.
Figure 3B:
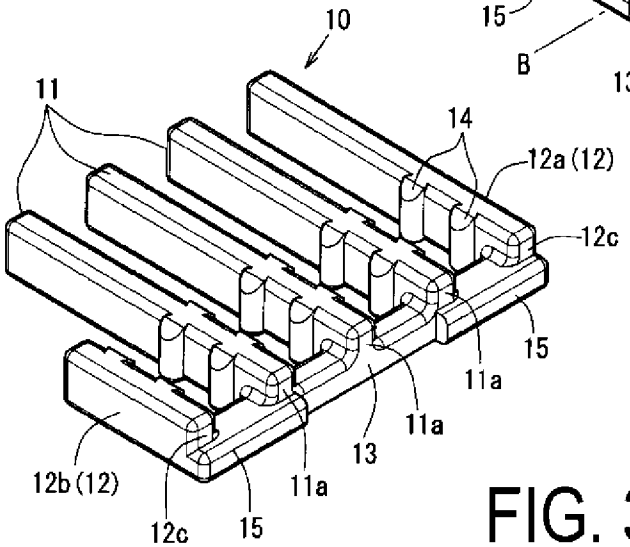
Figure 3C:
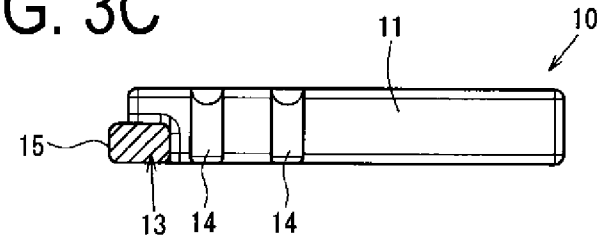

FIG. 1 illustrates a schematic perspective view of a wire assembly 100, FIGS. 2A and 2B illustrate explanatory views of a holder 130, and FIGS. 3A to 3C illustrate explanatory views of a terminal holder 10. Specifically, FIG. 2A illustrates an enlarged perspective view of a fixed-side holder 130*a* in an open state, and FIG. 2B illustrates an enlarged perspective view of a movable-side holder 130*b* in an open state. Further, FIG. 3A illustrates a perspective view of the terminal holder 10 from above the right side, FIG. 3B illustrates a perspective view of the terminal holder 10 from above the left side, and FIG. 3C illustrates a cross-sectional view along A-A illustrated in FIG. 3A.

Figure 4:
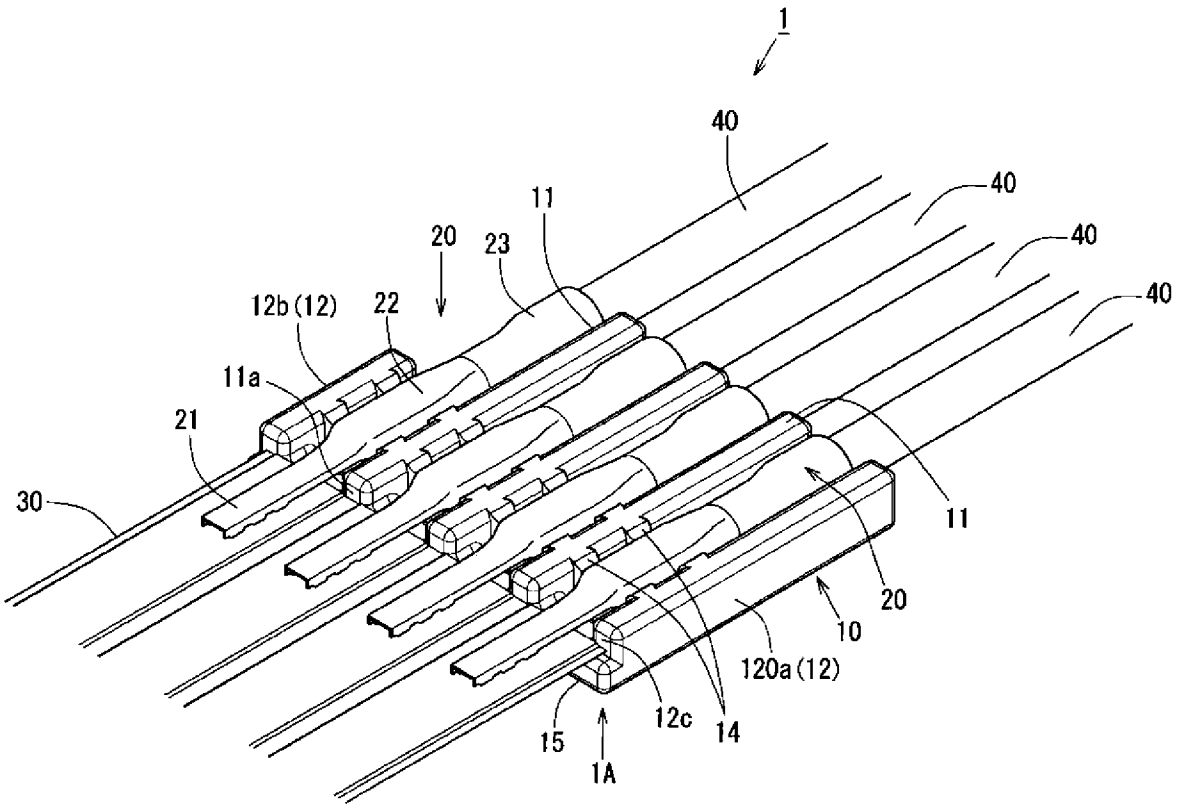
FIG. 4 illustrates a perspective view of a connecting portion of a connection structure body.
Figure 5:
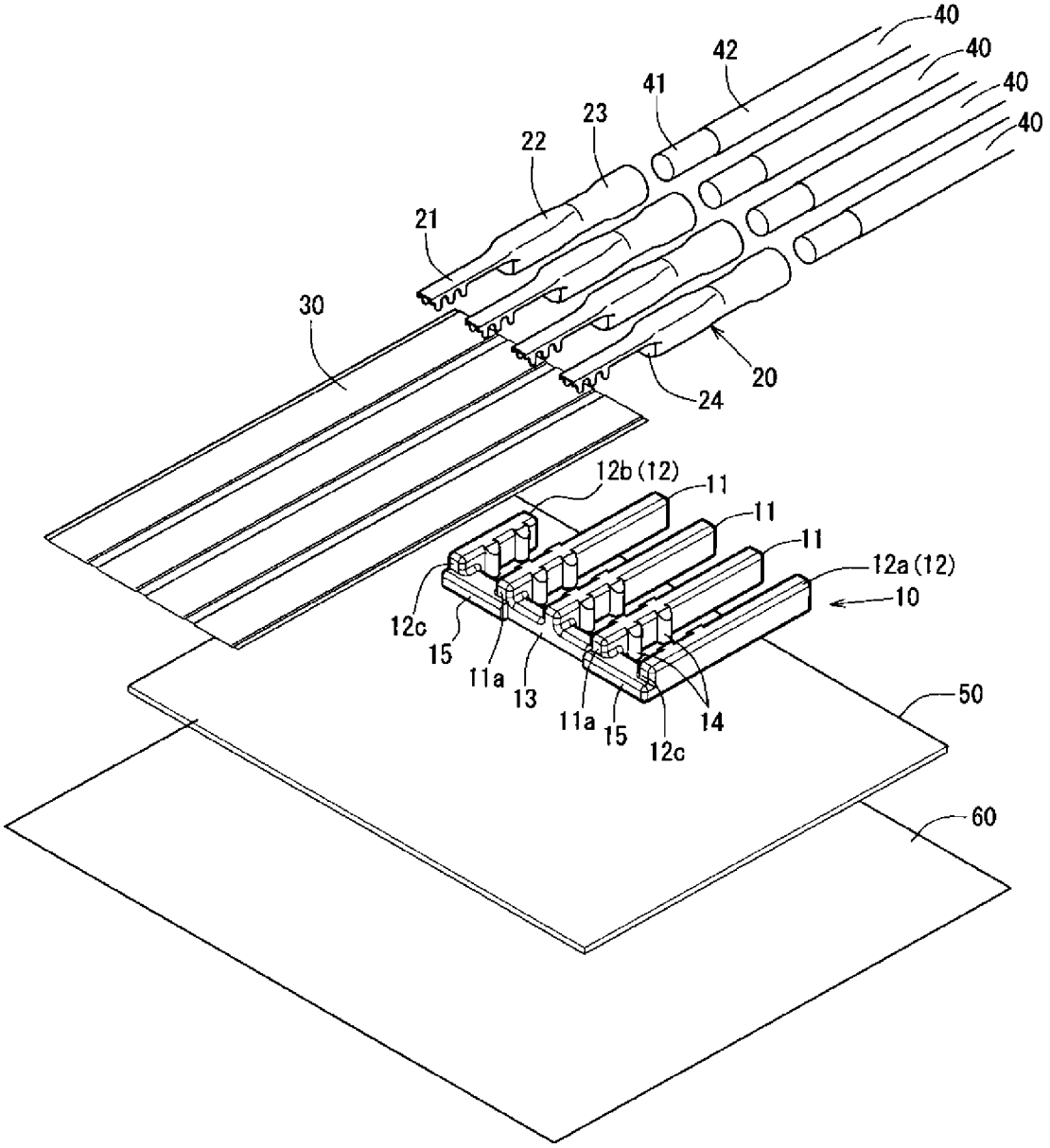
FIG. 5 illustrates an exploded perspective view of the connecting portion of the connection structure body.
Figure 6:
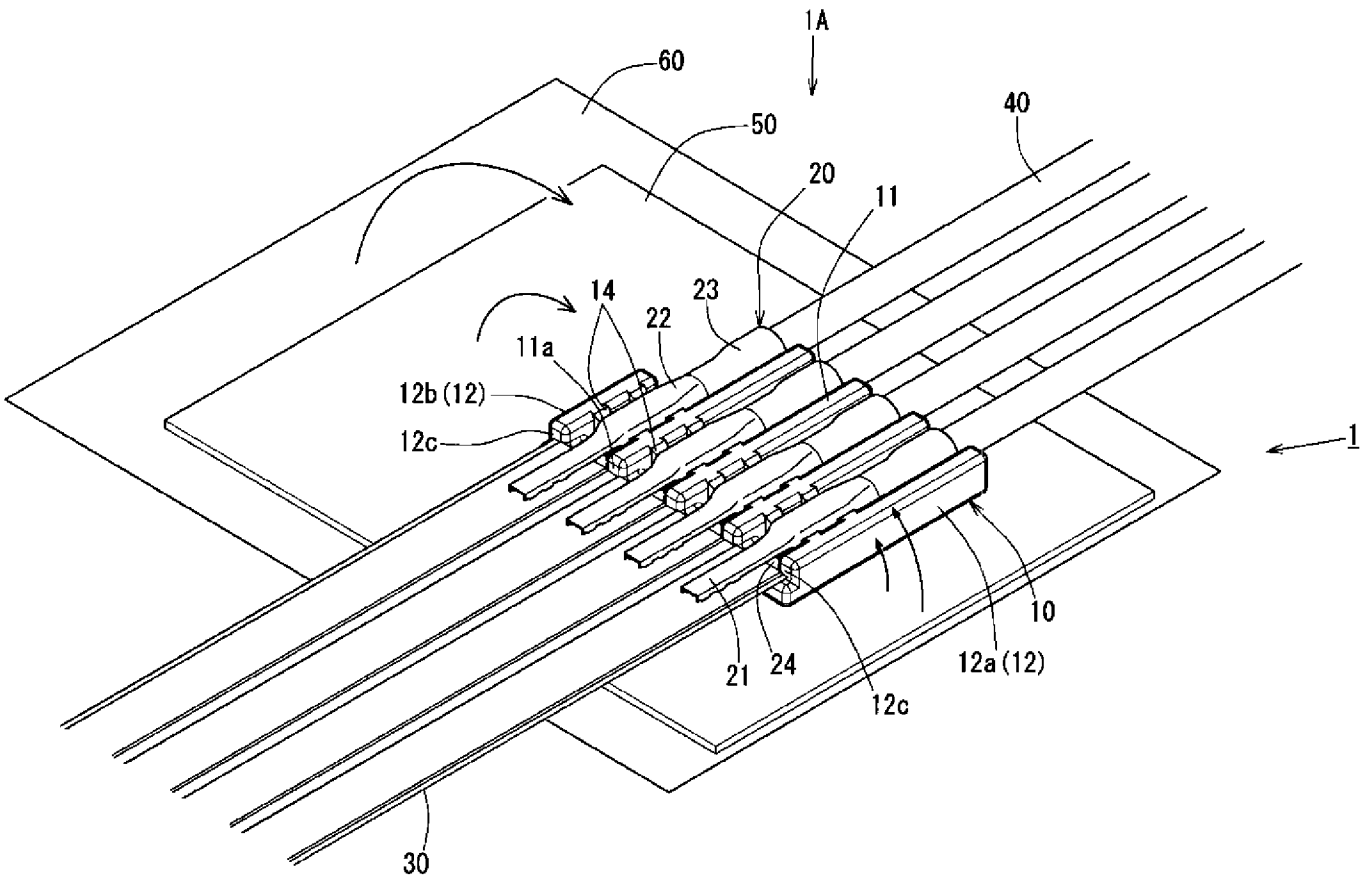
FIG. 6 illustrates a perspective view of the connecting portion of the connection structure body before pressure coating.
Figures 7A, 7B, 7C, 7D:
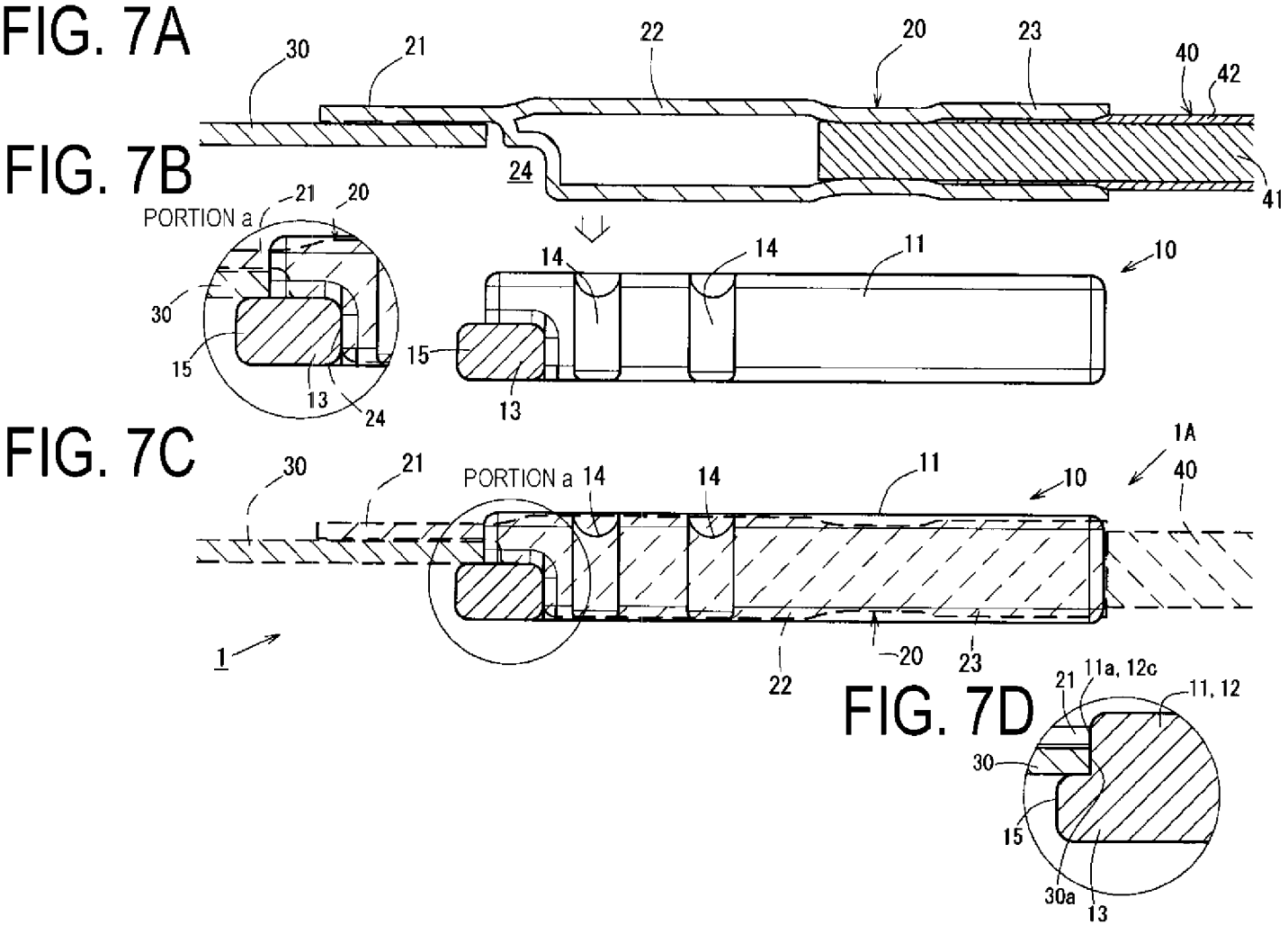
FIGS. 7A to 7D illustrate explanatory views of the connecting portion of the connection structure body.

FIG. 4 illustrates a perspective view of a waterproof connecting portion 1A of a connection structure body 1, FIG. 5 illustrates an exploded perspective view of the waterproof connecting portion 1A, FIG. 6 illustrates a perspective view of the waterproof connecting portion 1A before pressure coating, and FIGS. 7A to 7D illustrate explanatory views of the waterproof connecting portion 1A. Specifically, FIG. 7A illustrates a vertical end surface view of the waterproof connecting portion 1A before assembly, FIG. 7B illustrates a vertical end surface view of the waterproof connecting portion 1A, FIG. 7C illustrates an enlarged view of portion a in FIG. 7B, and FIG. 7D illustrates an enlarge view of a location corresponding to the portion a in an end surface view along line B-B illustrated in FIG. 3A. Note that FIGS. 7B and 7C illustrate a WF terminal 20, an FFC 30, and an insulated wire 40 using dashed lines. Further, in FIGS. 4 and 7A to 7D, a butyl sheet 50 and a seal 60 that constitute the waterproof connecting portion 1A are not illustrated.

The wire assembly 100 illustrated in FIG. 1 is a wire assembly for an electrical connection in a movable portion of a sliding door or the like, and includes a flexible flat cable unit 110 that is movable, the holders 130 disposed on both ends of the flexible flat cable unit 110, and a wire harness 120 (hereinafter referred to as "WH 120") that extends from the holders 130 to the outside.

The flexible flat cable unit 110 includes a plurality of the flexible flat cables 30 (hereinafter individually referred to as FFC 30; refer to FIG. 4) that overlap. The FFCs 30 are each formed by sandwiching a plurality of flat conductors (not illustrated) arranged in parallel in a width direction (up-down direction in FIG. 1) in a sheet-like insulating covering. Note that, the wire assembly 100 of the present embodiment includes the flexible flat cable unit 110 provided with four FFCs 30.

The WH 120 is formed by bundling together a plurality of the insulated wires 40, and includes a fixed-side WH 120*a* that extends from the fixed-side holder 130*a* described later, and a movable-side WH 120*b* that extends from the movable-side holder 130*b*.

The holders 130 are provided on both ends of the flexible flat cable unit 110, and are configured to house the waterproof connecting portion 1A of the connection structure body 1 that constitutes the flexible flat cable unit 110 in an interior thereof, with one serving as the fixed-side holder 130*a* and the other serving as the movable-side holder 130*b*.

Specifically, as illustrated in FIG. 2A, the fixed-side holder 130*a* is configured so that an end portion on the fixed side of the flexible flat cable unit 110 is looped back and inserted into the interior thereof, the waterproof connecting portion 1A described later is housed therein, and the fixed-side WH 120*a* extends from the waterproof connecting portion 1A housed therein to the outside.

Further, as illustrated in FIG. 2B, the movable-side holder 130*b* is configured so that an end portion on the movable side of the flexible flat cable unit 110 is inserted into the interior thereof, the waterproof connecting portion 1A described later is housed therein, and the movable-side WH 120*b* formed by bundling the insulated wires 40 that extend from the waterproof connecting portion 1A housed therein extends to the outside.

The holders 130 (130*a*, 130*b*) thus configured are each provided with a holder housing 131 having a housing space that is open on an upper side and capable of housing a plurality of the waterproof connecting portions 1A in an interior thereof, and a lid body 132 that covers the upper side of the housing space. The lid body 132 is openably and closably attached to the holder housing 131.

Note that the holders 130 of the present embodiment are each configured so that four vertically oriented waterproof connecting portions 1A corresponding to the number of FFCs 30 that constitute the flexible flat cable unit 110 are disposed side by side in a depth direction in the housing space.

The fixed-side WH 120*a*, the flexible flat cable unit 110, and the movable-side WH 120*b* of the wire assembly 100 thus configured are electrically connected via the holders 130. Specifically, the insulated wires 40 constituting the fixed-side WH 120*a*, the FFCs 30 constituting the flexible flat cable unit 110, and the insulated wires 40 constituting the movable-side WH 120*b* are connected by the waterproof connecting portions 1A to form each of the connection structure bodies 1, and the plurality of the waterproof connecting portions 1A of each of the connection structure bodies 1 are housed together in the holders 130, thereby forming the wire assembly 100.

Thus, because the waterproof connecting portions 1A have waterproofing properties as described later, the wire assembly 100 formed by the connection structure bodies 1 provided with the waterproof connecting portions 1A also has waterproofing properties, and the fixed-side WH 120*a* and the movable-side WH 120*b* are respectively connected to an electrical device and power supply device, making it possible to construct an electrical connection structure with waterproofing properties in a movable portion of a sliding door or the like.

Next, the configuration of the waterproof connecting portion 1A of the connection structure body 1 constituting the wire assembly 100 described above will be described.

The plurality of connection structure bodies 1 put together to form the wire assembly 100 are each configured by connecting the FFCs 30 and the insulated wires 40 using the waterproof connecting portion 1A.

The waterproof connecting portion 1A that connects the FFCs 30 and the insulated wires 40, as illustrated in FIG. 5, includes the terminal holder 10, the WF terminals 20, the butyl sheet 50, and the seal 60.

The FFC 30 is configured by sandwiching a plurality of flat conductors (not illustrated) arranged in parallel in the width direction in a sheet-like insulating covering. Note that, in the present embodiment, the FFC 30 includes four flat conductors.

The insulated wire 40 has a round cross-sectional surface and is obtained by covering a conductor 41 with an insulating covering 42 as illustrated in FIG. 5, and is provided in a quantity equivalent to the number of flat conductors of the FFC 30.

The WF terminal 20 electrically connects the flat conductors of the FFC 30 and the conductor 41 of the insulated wire 40, and is configured by arranging in series a piercing connecting portion 21 that pierces the FFC 30 in a thickness direction, connecting the FFC 30, a crimp connecting portion 23 that makes a crimped connection to a tip of the insulated wire 40, and a box portion 22 that has a hollow rectangular cross section and is disposed between the piercing connecting portion 21 and the crimp connecting portion 23.

Further, as illustrated in FIGS. 5 and 7A, a groove portion 24 that fits together with a linking portion 13 of the terminal holder 10 is provided at a boundary portion of the piercing connecting portion 21 and the box portion 22 on a bottom surface side.

The terminal holder 10, as illustrated in FIGS. 3A to 3C, forms a substantially fence-like shape in a planar view with three rod-like portions 11 disposed at a prescribed interval in the width direction, outer frame rod-like portions 12 (12*a*, 12*b*) disposed at the same interval on both outer sides of the rod-like portions 11, and the linking portion 13 that links the three rod-like portions 11 and the two outer frame rod-like portions 12 on a first end side (frontward side in FIG. 4).

Note that the three rod-like portions 11 and the two outer frame rod-like portions 12 are formed with a substantially oblong cross section having a height that is the same as the height of the box portion 22 of the WF terminal 20, and the outer frame rod-like portion 12*a* of the two outer frame rod-like portions 12 and the three rod-like portions 11 are formed at a length that is substantially the same as the length of the box portion 22 and the crimp connecting portion 23 of the WF terminal 20. The other short outer frame rod-like portion 12*b* of the two outer frame rod-like portions 12 is formed at a length that is about half that of the outer frame rod-like portion 12*a* and the rod-like portion 11.

Further, two support portions 14 having an inward protruding projection-like shape (substantially semi-cylindrical shape) are provided at a prescribed interval in the length direction on each of the side surfaces facing the five rod-like portions 11 and outer frame rod-like portions 12 adjacent to each other.

Note that the support portions 14 are not limited to a substantially semi-cylindrical shape, and need only have a suitable shape that protrudes inward, such as a substantially semi-elliptical cylindrical shape, a substantially triangular cylindrical shape, or a rectangular cylindrical shape. Further, the shape need not be cylindrical, and may be a plurality of projections disposed in the height direction.

The linking portion 13 that links, in the width direction, first ends of the three rod-like portions 11 and the two outer frame rod-like portions 12 disposed at a prescribed interval in the width direction has a horizontally long cross section formed at approximately half the height of that of the rod-like portions 11 and the outer frame rod-like portions 12.

Further, an overlapping portion 15 that protrudes to a front surface side is provided between the outer frame rod-like portion 12*a* on the front surface side of the linking portion 13 and the adjacent rod-like portion 11 as well as between the short outer frame rod-like portion 12*b* and the adjacent rod-like portion 11, that is, to outer side portions in the width direction of the linking portion 13.

The butyl sheet 50 that functions as a waterproof covering member is made from a sheet of butyl rubber having a 2-mm thickness and is configured to have a width that is about double that of the FFC 30 and a rectangular shape with a length twice as long as that of the WF terminal 20. However, as long as the base material of the butyl sheet 50 has insulating properties, waterproofing properties, and stretching properties, the material is not limited thereto, and a rubber other than a butyl rubber that has insulating properties may be used, such as an isoprene rubber, a butadiene rubber, or a silicon rubber, for example.

That is, the waterproof covering member is formed from a rubber member having insulating properties, waterproofing properties, and stretching properties.

Further, the length of the butyl sheet 50 with respect to the length direction is a size that sufficiently covers the connecting portion of the piercing connecting portion 21 and the FFC 30 and the connecting area of the crimp connecting portion 23 and the insulated wires 40, and the length of the butyl sheet 50 with respect to the width direction is at least equal to that of the outer periphery of the terminal holder 10.

The seal 60 serving as an outer side covering member that covers the butyl sheet 50 of the waterproof connecting portion 1A is a multi-layered film sheet made from a polyester having a 0.1-mm thickness, insulating properties, and waterproofing properties, and is configured to be larger in size than the butyl sheet 50. Note that the base material of the seal 60 is not limited as long as the base material has insulating properties and waterproofing properties, and may be a vinyl chloride or a polyethylene, or a single-layer film sheet, for example. That is, the outer side covering member is formed from a film sheet having insulating properties and waterproofing properties.

In the waterproof connecting portion 1A thus constituting each element, first the piercing connecting portions 21 of the WF terminal 20 connects the FFC 30 by piercing, and the crimp connecting portion 23, upon insertion of the conductor 41 of the insulated wire 40, connects the conductor 41 by crimping. This is done for each of the flat conductors of the FFCs 30 and then, for one FFC 30, the four insulated wires 40 are connected using the four WF terminals 20. At this time, the WF terminals 20 and the insulated wires 40 are connected so as to be in the same position in the length direction, and thus the four WF terminals 20 and the four insulated wires 40 are arranged in parallel in the width direction.

Then, the terminal holder 10 is assembled to the FFCs 30 and the four insulated wires 40 connected via the four WF terminals 20. At this time, as illustrated in FIG. 7D, an end surface 30*a* of each of the FFCs 30 comes into contact with a tip end surface 11*a* of the rod-like portion 11 and a tip end surface 12*c* of the outer frame rod-like portion 12, and is mounted on the overlapping portion 15 formed on the outer side portion in the width direction of the linking portion 13.

Furthermore, assembly is performed so that the linking portion 13 is fitted to the groove portion 24 of the WF terminal 20, the box portion 22 is fitted between the support portions 14 formed on the inner side surface facing the rod-like portion 11 and the outer frame rod-like portion 12 of the terminal holder 10, and the box portion 22 is supported between the support portions 14 facing each other.

Then, once the terminal holder 10 and each of the WF terminals 20 connecting the FFC 30 and the insulated wire 40 are assembled, the butyl sheet 50 and the seal 60 are folded as illustrated by the arrow in FIG. 6 so that the four WF terminals 20 that connect the four insulated wires 40 and the FFCs 30 mounted on the overlapping seal 60 and butyl sheet 50 are on the inner side. Pressure is then applied in the up-down direction by a pressure coating device (not illustrated), bonding the butyl sheet 50 and the seal 60 in the folded state and thus completing the waterproof connecting portion 1A.

In the following, the step of folding the butyl sheet 50 and the seal 60 will be described in detail with reference to FIGS. 8 to 10.

Figure 8:
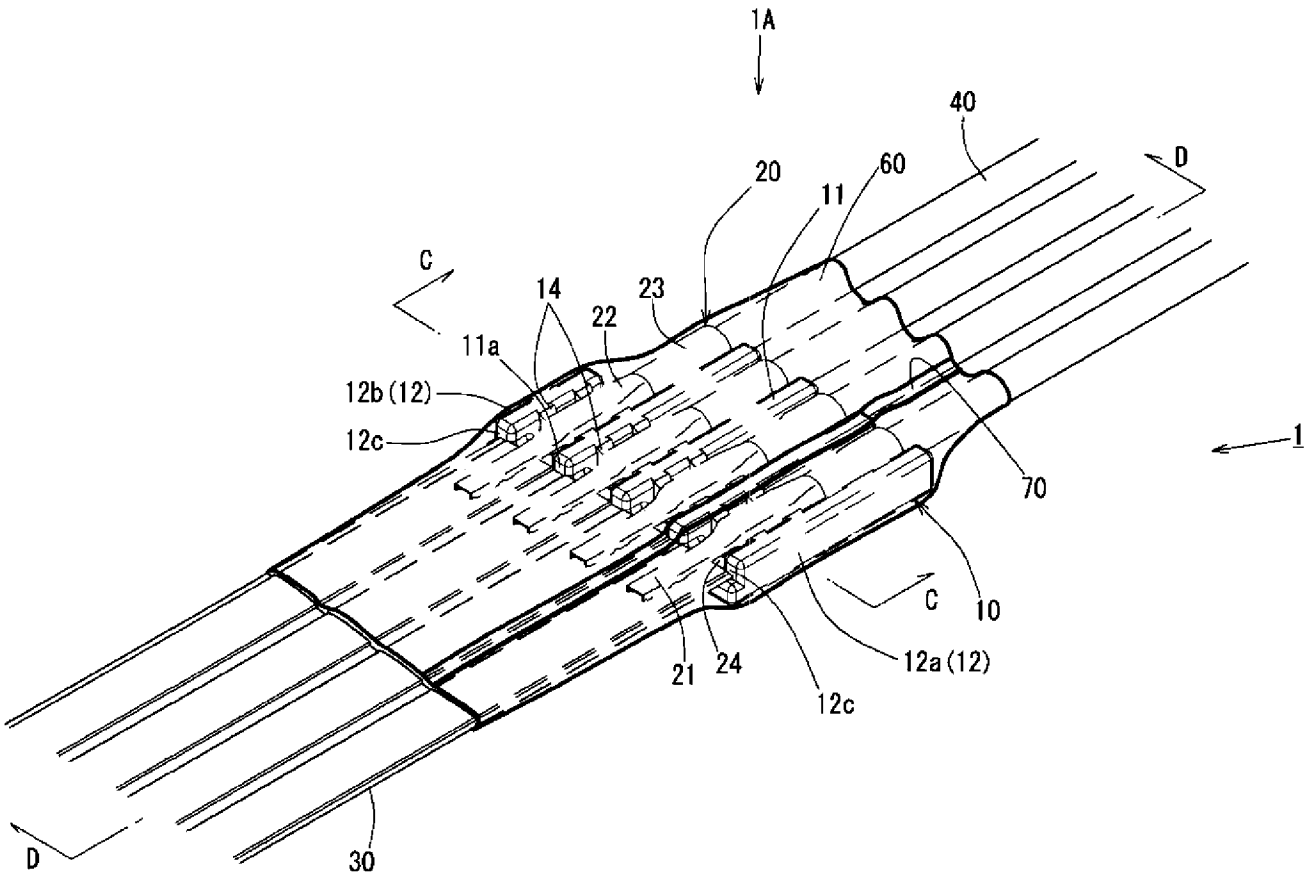
FIG. 8 illustrates a perspective view of a waterproof connection structure after pressure coating.

Here, FIG. 8 illustrates a perspective view of the waterproof connecting portion 1A after pressure coating. Note that FIG. 8 indicates the terminal holder 10 and the like by dashed lines in a transparent view, clearly illustrating the interior of the waterproof connecting portion 1A.

Figure 9A:
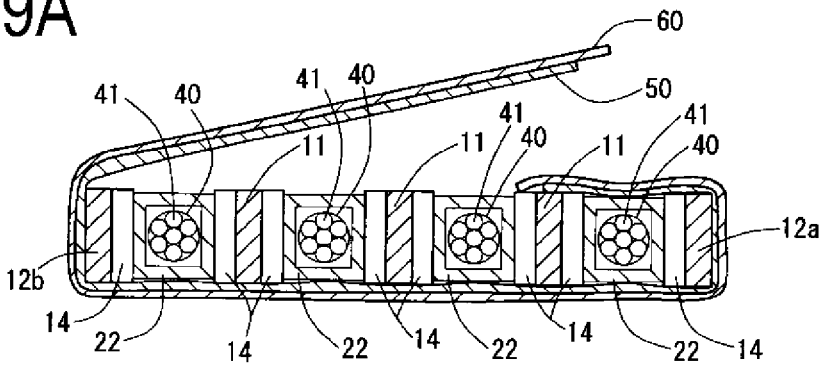
FIGS. 9A to 9C illustrate explanatory views of a folding step of the waterproof connection structure.
Figure 9B:
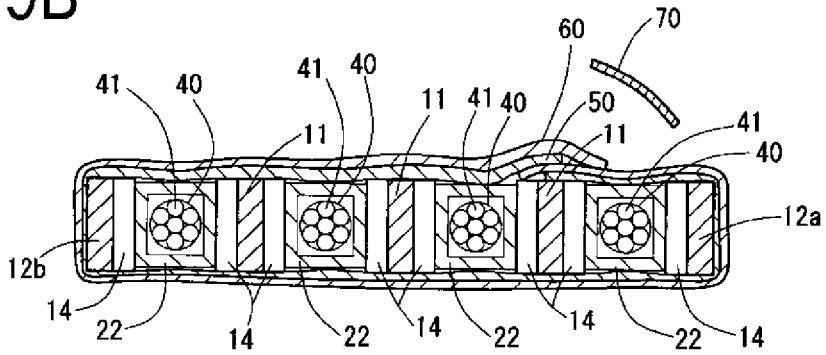
Figure 9C:
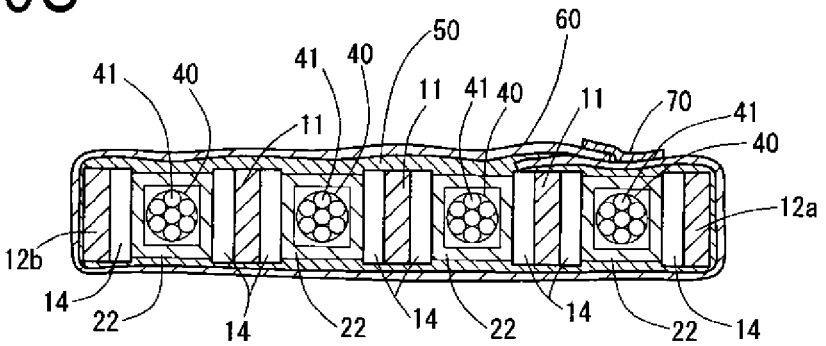
Figure 10:
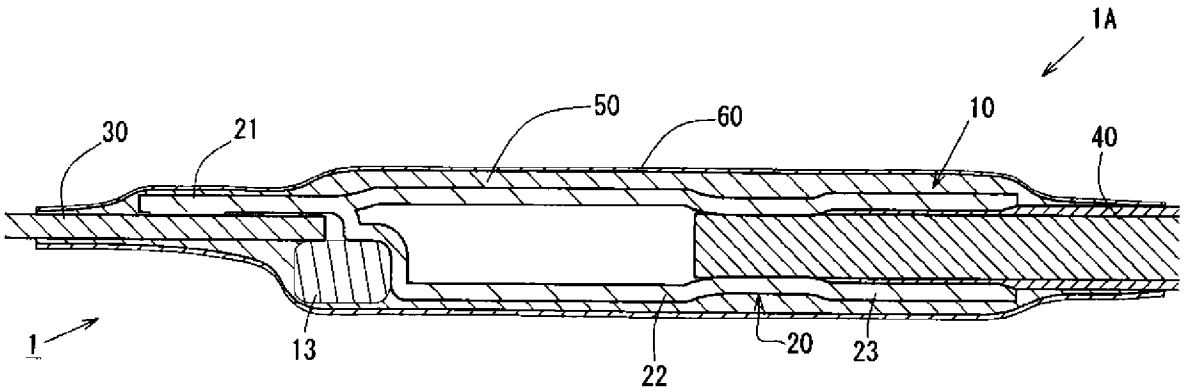
FIG. 10 illustrates a cross-sectional view of the connecting portion of the waterproof connection structure after pressure coating.

FIGS. 9A to 9C illustrate cross-sectional views along C-C in FIG. 8 for explaining the folding step of the waterproof connecting portion 1A, and FIG. 10 illustrates a cross-sectional view along D-D in FIG. 8. Specifically, FIG. 9A illustrates a cross-sectional view along C-C of the first end sides in the width direction of the folded butyl sheet 50 and the seal 60, FIG. 9B illustrates a cross-sectional view along C-C of the second end sides in the width direction of the folded butyl sheet 50 and the seal 60, and FIG. 9C illustrates a cross-sectional view along C-C of the folded state after pressure coating.

The butyl sheet 50, as illustrated in FIG. 6, fits on the inner side of the seal 60 and is disposed biased to the first end side in the width direction of the seal 60. That is, the spacing between the first end sides in the width direction of the butyl sheet 50 and the seal 60 is configured to be short compared to the spacing between the second end sides.

The terminal holder 10 with the WF terminals 20 connecting the FFCs 30 and the insulated wires 40 assembled thereto is mounted on the butyl sheet 50 thus configured so that the outer frame rod-like portion 12*a* extends along the first end in the width direction of the butyl sheet 50 and the area from the connecting portion where the piercing connecting portions 21 and the FFCs 30 are connected to the connecting portion where the crimp connecting portions 23 and the insulated wires 40 are connected by crimping fits in the interior of the butyl sheet 50. Note that a distance between the first end in the width direction of the butyl sheet 50 and the outer frame rod-like portion 12*a* is shorter than a distance between the second end in the width direction of the butyl sheet 50 and the short outer frame rod-like portion 12*b*.

The first end sides in the width direction of the butyl sheet 50 and the seal 60 with the terminal holder 10 mounted thereto are folded so that the WF terminals 20 are on the inner side (refer to FIG. 9A), and the then second end sides of the butyl sheet 50 and the seal 60 are folded so that the WF terminals 20 are on the inner side. As a result, the butyl sheet 50 and the seal 60 surround the outer periphery of the terminal holder 10 with the second end side in the width direction of the folded butyl sheet 50 overlapping the first end sides in the width direction of the butyl sheet 50 and the seal 60 covering the upper surfaces of the rod-like portions 11 disposed on the first end side in the width direction (refer to FIG. 9B). That is, the folded butyl sheet 50 and the seal 60 wrap around the WF terminals 20 and the like in the width direction, and the first end sides and the second end sides in the width direction overlap in the circumferential direction.

Then, the location where the second end in the width direction of the seal 60 overlaps is covered by a boundary cover 70 formed from the same base material as that of the seal 60 and having stickiness on a bottom surface. The butyl sheet 50 and the seal 60 are then pressurized in the up-down direction using a pressure coating device (not illustrated), thereby fitting and bonding the butyl sheet 50 to recesses and projections where the terminal holder 10 and the WF terminals 20 are formed. The butyl sheet 50 also enters the space formed in the overlapping portion of the first end sides and the second end sides in the width direction of the butyl sheet 50 and the seal 60, bonding together the butyl sheet 50 and the seal 60 and thus completing the waterproof connecting portion 1A (refer to FIG. 9C).

As illustrated in FIG. 10, with the waterproof connecting portion 1A thus configured, the butyl sheet 50 that functions as a waterproof covering member is bonded to and covers the area from one portion of the FFCs 30 that includes the connecting portion of the piercing connecting portions 21 and the FFCs 30 to one portion of the insulated wires 40 that includes the crimp connecting portions 23 that make a crimped connection with the conductors 41 of the insulated wires 40. Further, the sheet 60 that functions as an outer side covering member covers the outer periphery of the butyl sheet 50. As a result, water penetration into the interior of the waterproof connecting portion 1A, which includes exposed metal portions, can be prevented.

Further, the portion where the second end in the width direction of the seal 60 overlaps is sealed by the boundary cover 70 that functions as an overlapping area covering member, making it possible to prevent water penetration from the boundary portion where the second end in the width direction of the seal 60 overlaps, an area readily susceptible to moisture entry and the like, and thus better prevent water penetration into the interior of the waterproof connecting portion 1A.

Note that, while the boundary cover 70 serving as the overlapping area covering member is formed from the same base material as that of the seal 60 except for having an adhesive layer, the base material does not necessarily need to be the same, and may be changed to a film sheet having suitable insulating properties and waterproofing properties.

The connection structure body 1, which includes the FFCs 30 that are formed by sandwiching a plurality of flat conductors arranged in parallel in the width direction in a sheet-like insulating covering, the plurality of insulated wires 40 each obtained by covering the conductor 41 with the insulating covering 42, the plurality of WF terminals 20 that are arranged in parallel in the width direction and connect the flat conductors and the conductors 41, the terminal holder 10 that partitions the WF terminals 20 in an insulating manner, and the butyl sheet 50 that integrally covers the plurality of WF terminals 20 partitioned by the terminal holder 10 and the terminal holder 10, and has waterproofing properties, insulating properties, and stretching properties, can easily and reliably waterproof the waterproof connecting portion 1A of the FFCs 30 and the insulated wires 40.

Specifically, while the WF terminals 20 that connect the flat conductors of the FFCs 30 and the conductors 41 of the insulated wires 40 are arranged in parallel in the width direction, the rod-like portions 11 of the terminal holder 10 that partitions the WF terminals 20 in an insulating manner are provided, making it possible to reliably connect the flat conductors and the conductors 41 without the WF terminals 20 inadvertently coming into contact and causing a short circuit. Note that the terminal holder 10 is small compared to the protective case that houses the WF terminals 20 and the like, for example, making it possible to compactly configure the waterproof connecting portion 1A and reduce part costs.

Further, the plurality of WF terminals 20 and the terminal holder 10 are integrally covered by the butyl sheet 50 having waterproofing properties, insulating properties, and stretching properties, and thus, compared to a waterproof structure filled with a sealing material, it is possible to easily achieve at least the same level of waterproofing properties at low cost. As a result, the waterproof connecting portion 1A and the connection structure body 1 capable of reliably preventing water penetration can be achieved efficiently and at low cost.

Further, the butyl sheet 50 is pressure coated onto the WF terminals 20 and the terminal holder 10 so as to cover the WF terminals 20 and the terminal holder 10, making it possible to construct a connection structure having improved waterproofing properties.

Further, the terminal holder 10 includes the rod-like portions 11 having a rod shape and insulating properties, the outer frame rod-like portions 12 (12*a*, 12*b*) disposed on the outer sides of the plurality of WF terminals 20 arranged in parallel, and the linking portion 13 that links the rod-like portions 11 and the outer frame rod-like portions 12 on the first end sides (frontward sides in FIG. 4) in the length direction of the rod-like portions 11, making it possible to construct a connection structure that prevents water penetration while reliably maintaining the positions of the WF terminals 20 arranged in parallel in the width direction.

Specifically, when the arrangement of the plurality of WF terminals 20 arranged in parallel deforms due to twisting or the like when covered with the butyl sheet 50, for example, the possibility exists that the WF terminals 20 will contact each other, causing a defect such as a short circuit, leading to deterioration of the waterproofing properties. The terminal holder 10, however, is configured as described above, making it possible to maintain the arrangement of the plurality of WF terminals 20 even when covered by the butyl sheet 50, and thus construct a connection structure that prevents water penetration while reliably maintaining the positions of the WF terminals 20 arranged in parallel in the width direction.

Further, because a plurality of the rod-like portions 11 are provided, it is possible to construct the waterproof connecting portion 1A capable of reliably preventing water penetration without shorting the WF terminals 20, even when the FFCs 30 each include three or more flat conductors.

Further, the rod-like portions 11 and the outer frame rod-like portions 12 are configured at about the same height as that of the WF terminals 20, making it possible to construct the waterproof connecting portion 1A having reliable waterproofing properties without producing an unnecessary space on an inner side covered by the butyl sheet 50 and deteriorating the waterproofing properties.

Further, the outer frame rod-like portion 12*a* and the short outer frame rod-like portion 12*b* disposed on both outer sides of the plurality of WF terminals 20 are formed at different lengths, making it possible to visually check the assembly direction of the terminal holder 10 and execute construction without mistaking the preferred waterproof connecting portion 1A.

Further, the rod-like portions 11 are formed at substantially the same length as the length of the box portion 22 and the crimp connecting portion 23 of the WF terminals 20, making it possible to prevent the possibility of the crimp connecting portion 23 of the WF terminal 20 connected to independent insulated wires 40 from inadvertently coming into contact and causing a short circuit or the like.

Further, the overlapping portions 15 that overlap in the height direction with the end portions of the FFCs 30 are provided to the linking portion 13, making it possible to regulate the relative positions in the height direction (thickness direction) of the FFCs 30 and the terminal holder 10 and thus construct the preferred waterproof connecting portion 1A without a shift in the height direction (thickness direction) of the FFCs 30 and the terminal holder 10.

Further, by providing the tip end surfaces 11*a* and the tip end surface 12*c* contacting the end surfaces 30*a* of the FFCs 30 in the length direction, the positions of the FFCs 30 in the length direction with respect to the terminal holder 10 can be regulated, making it possible to regulate the relative positions in the length direction of the FFCs 30 and the terminal holder 10, and construct the preferred waterproof connecting portion 1A without a shift in the length direction of the FFCs 30 and the terminal holder 10.

Further, the groove portions 24 into which the linking portion 13 is fitted are provided, making it possible to regulate the relative positions in the length direction of the WF terminals 20 and the terminal holder 10, and construct a compact waterproof connecting portion 1A to the extent of the height of the groove portions 24.

Further, the WF terminal 20 includes the piercing connecting portion 21 that connects with the flat conductor in a conducting manner, the crimp connecting portion 23 that connects with the conductor 41 in a conducting manner, and the box portion 22 disposed between the piercing connecting portion 21 and the crimp connecting portion 23, and the terminal holder 10 is provided with the support portions 14 that support the box portion 22, making it possible to support the box portion 22 having mechanical strength with the support portions 14 and reliably maintain the WF terminal 20 with respect to the terminal holder 10.

Further, the butyl sheet 50 is a general base material of the waterproofing covering member having a stable, uniform quality, making it possible to easily construct the waterproof connecting portion 1A having stable waterproofing properties at low cost.

Furthermore, the outer side of the butyl sheet 50 is enclosed by the seal 60. As a result, when a plurality of the butyl sheets 50 are housed side by side in the housing space of the holder 130, it is possible to prevent the butyl sheets 50 from sticking to each other.

Further, the butyl sheet 50 and the seal 60 integrally cover the area from one portion of the FFCs 30 that includes the connecting portion of the piercing connecting portions 21 and the FFCs 30 to one portion of the insulated wires 40 that includes the crimp connecting portions 23 that make a crimped connection with the conductors 41 of the insulated wires 40. Further, the boundary cover 70 covers the boundary portion where the second end in the width direction of the seal 60 overlaps. As a result, water penetration into the interior of the waterproof connecting portion 1A, which includes exposed metal portions, can be reliably prevented.

While, in the correspondence between the configuration of this invention and the embodiments described above, the flat cable of this invention corresponds to the FFC 30 and, similarly, the connection terminal corresponds to the WF terminal 20, the partition member corresponds to the terminal holder 10, the waterproof covering member corresponds to the butyl sheet 50, the outer frame portions correspond to the outer frame rod-like portions 12 (12*a*, 12*b*), the position regulating portions correspond to the tip end surface 11*a* and the tip end surfaces 12*c*, the flat conductor connecting portion corresponds to the piercing connecting portion 21, the conductor connecting portion corresponds to the crimp connecting portion 23, and the waterproof connection structure corresponds to the waterproof connecting portion 1A, this invention is not limited to the embodiments described above.

Figures 11A, 11B, 11C:
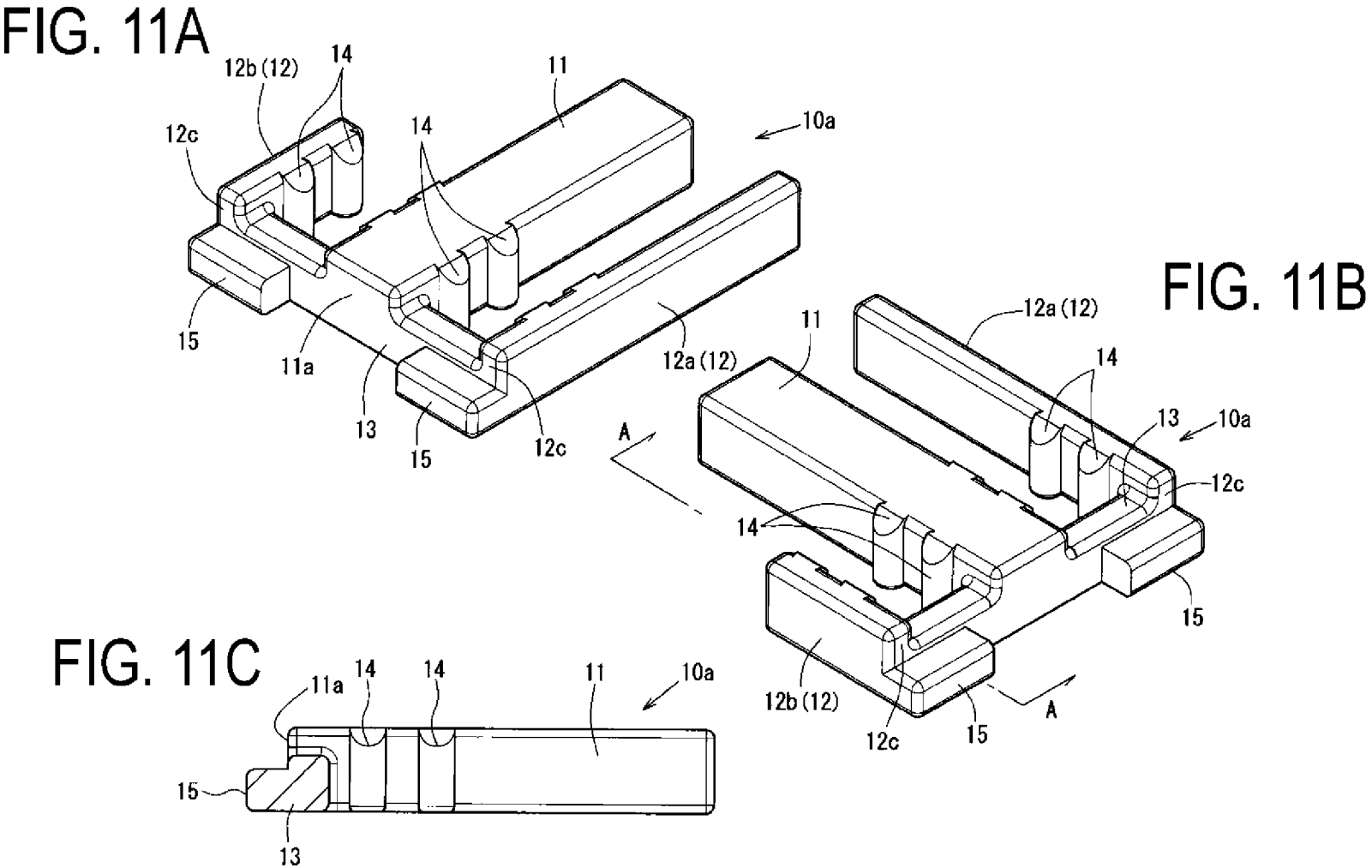
FIGS. 11A to 11C illustrate explanatory views of the terminal holder of another embodiment.
Figure 12:
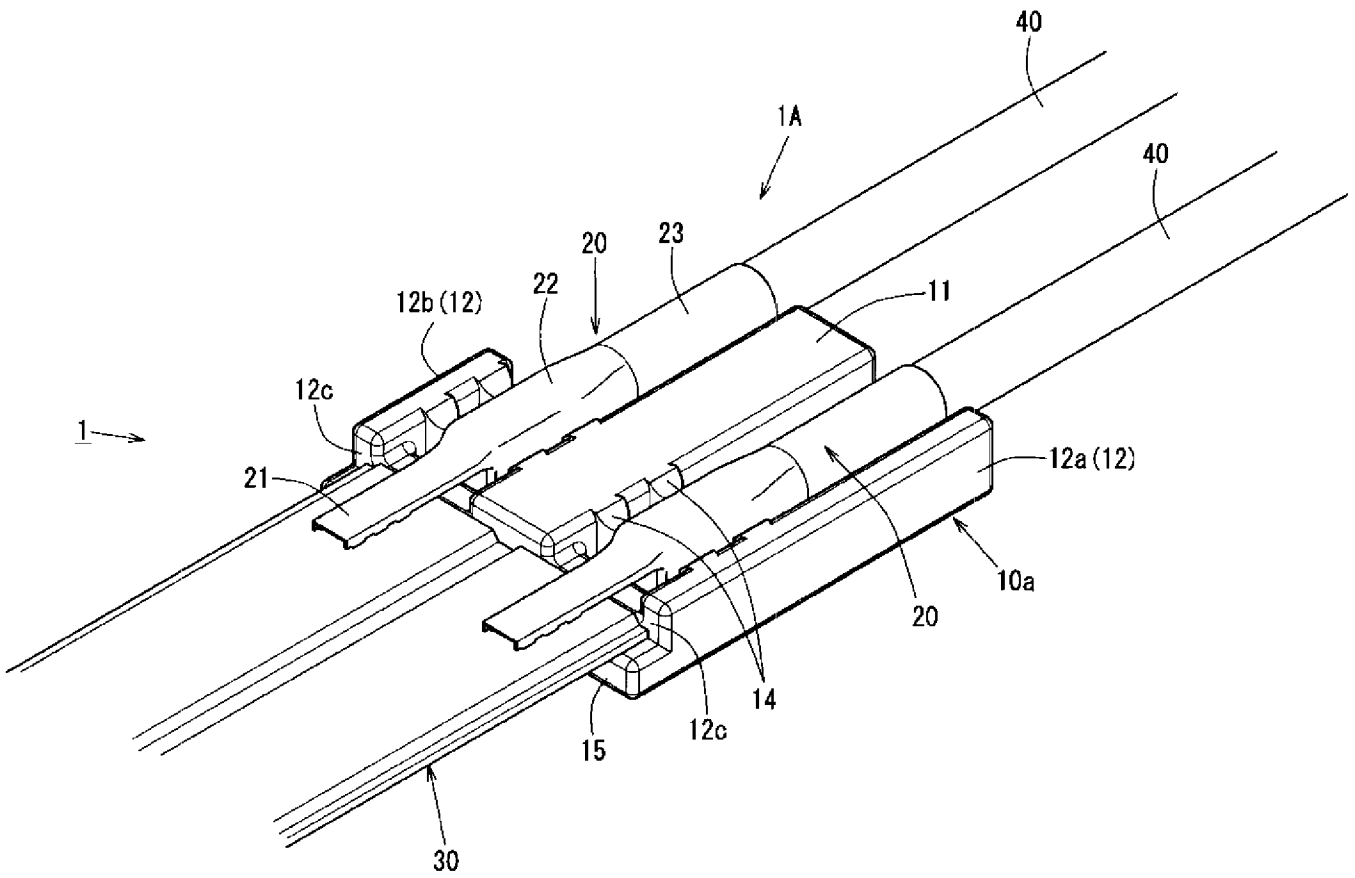
FIG. 12 illustrates a perspective view of the connecting portion of the connection structure body of another embodiment.

While the terminal holder 10, which has a fence-like configuration with the three rod-like portions 11 and the two outer frame rod-like portions 12 linked by the linking portion 13 using the four WF terminals 20, is used to connect the FFCs 30 provided with the four flat conductors to the same number (four) of insulated wires 40 in the description above, a terminal holder 10*a*, which has a fence-like configuration with one rod-like portion 11 and the two outer frame rod-like portions 12 linked by the linking portion 13 using two WF terminals 20, may be used to connect the FFCs 30 provided with two flat conductors to the same number (two) of insulated wires 40, as illustrated in FIGS. 11A to 12. Note that, in FIGS. 11A to 12, the components of the terminal holder 10*a* that are the same as those of the terminal holder 10 described above are denoted using the same reference numerals, and the same advantages as those of the waterproof connecting portion 1A that uses the terminal holder 10 as described above can be achieved.

Further, while the WF terminals 20 obtained by integrating the piercing connecting portion 21, the box portion 22, and the crimp connecting portion 23 were used, a piercing terminal that connects with flat non-conductors of the FFC 30 and a crimping terminal that makes a crimped connection with the conductor 41 of the insulated wire 40 may be configured to fit together as a male and female coupling in place of the WF terminal 20.

Furthermore, the crimping terminal that makes a crimped connection with the conductor 41 of the insulated wire 40 may be an open-barrel terminal or a closed-barrel terminal.

Further, in place of the butyl sheet 50, a sheet-like member made from silicon or the like may be provided, and the shape is not limited to a sheet-like shape, allowing covering using a cover member formed into a solid shape in advance.

Further, while the butyl sheet 50 is a sheet made from a butyl rubber and therefore has stickiness in the present embodiment, an adhesive layer may be provided to the seal 60 as well. This makes it possible to adhere the butyl sheet 50 and the seal 60 more strongly and configure the butyl sheet 50 using a base material other than a butyl rubber. Furthermore, because the overlapping portion of the folded seal 60 can be connected by crimping, the boundary of the overlapping portion of the seal 60 can be sealed without using the boundary cover 70.

Further, while the butyl sheet 50 is a sheet made from a butyl rubber having a 2-mm thickness in the present embodiment, the thickness does not need to be limited to 2 mm and may be changed as appropriate. Preferably, the thickness of the butyl sheet 50 serving as the waterproof covering member is from 1 to 3 mm, inclusive.

When the thickness of the butyl sheet 50 is less than 1 mm, the butyl sheet 50 deformed by pressurization cannot always fully fill in the space between the seal 60 and the recesses and projections formed by the terminal holder 10, the WF terminals 20, and the like, resulting in slight deterioration of the waterproofing properties when moisture enters the interior.

On the other hand, when the thickness of the butyl sheet 50 is greater than 3 mm, the total area of the butyl sheet 50 increases, making it possible to reliably fill the space, etc., by pressurization, but the butyl sheet 50 may extend beyond the seal 60 and not be coverable by the seal 60.

Furthermore, while the seal 60 is a multi-layer film sheet made from a polyester having a 0.1-mm thickness in the present embodiment, the thickness does not need to be limited to 0.1 mm and may be any thickness. Preferably, the thickness of the seal 60 serving as the waterproof covering member is from 0.05 to 0.5 mm, inclusive.

When the thickness of the seal 60 is less than 0.1 mm, the seal 60 may become damaged during pressurization, deteriorating waterproofing properties. Further, when the thickness is greater than 0.5 mm, the thickness of the waterproof connecting portion 1A increases, making it necessary to secure space in the arranged location.

REFERENCE NUMBER

1 Connection structure body
1A Waterproof connecting portion
10 Terminal holder

11 Rod-like portion
11*a* Tip end surface
12, 12*a* Outer frame rod-like portion
12*b* Short outer frame rod-like portion
12*c* Tip end surface
13 Linking portion
14 Support portion
15 Overlapping portion
20 WF terminal
21 Piercing connecting portion
22 Box portion
23 Crimp connecting portion
24 Groove portion
30 FFC
40 Insulated wire
41 Conductor
42 Insulating covering
50 Butyl sheet

The invention claimed is:

1. A connection structure body comprising:

a flat cable formed by sandwiching a plurality of flat conductors arranged in parallel in a width direction in a sheet-like insulating covering;

a plurality of insulated wires each obtained by covering a conductor with an insulating covering;

a plurality of connection terminals that are arranged in parallel in the width direction and connect the flat conductors and the conductors;

a partition member that includes:

a plurality of insulating rod-like portions to partition the connection terminals in an insulating manner, adjacent insulating rod-like portions being separated by a predetermined distance, and a link that links the rod-like portions together only at a first end side of the rod-like portions that receives the flat conductors, the link extending less than a full length of the rod-like portions and being substantially half of a height of the rod-like portions; and a waterproof covering member that integrally covers the plurality of connection terminals partitioned by the partition member and the partition member, and has waterproofing properties, insulating properties, and stretching properties.

2. The connection structure body according to claim 1, wherein the waterproof covering member covers the connection terminals and the partition member by being pressurized onto the connection terminals and the partition member.

3. The connection structure body according to claim 1, wherein the partition member further includes outer frame portions disposed on outer sides of the plurality of rod-like portions and arranged in parallel, and the link further links the rod-like portions to the outer frame portions.

4. The connection structure body according to claim 3, wherein the outer frame portions disposed on both outer sides of the plurality of rod-like portions are formed at different lengths.

5. The connection structure body according to claim 3, wherein:

a second end side of the rod-like portions is disposed near a side of the connection terminals opposite the flat cable.

6. The connection structure body according to claim 5, wherein the link comprises an overlapping portion that overlaps with an end portion of the flat cable in a height direction.

7. The connection structure body according to claim 5, wherein the link comprises a position regulating portion that regulates a position in the length direction with an end surface of the flat cable in contact in the length direction.

8. The connection structure body according to claim 5, wherein each of the plurality of connection terminals include a groove portion that allows the link to be fitted therein, between an end portion of the flat cable and a corresponding connection terminal.

9. The connection structure body according to claim 3, wherein the link and the outer frame portions form an open frame.

10. The connection structure body according to claim 1, wherein the connection structure body has a height that is substantially the same as a height of the connection terminals.

11. The connection structure body according to claim 1, wherein:

each of the connection terminals comprises a flat conductor connecting portion that connects with the flat conductor in a conducting manner, a conductor connecting portion that connects with the conductor in a conducting manner, and a box portion disposed between the flat conductor connecting portion and the conductor connecting portion; and the partition member comprises a support portion that supports the box portion.

12. The connection structure body according to claim 1, wherein the waterproof covering member is formed from a rubber sheet material.

13. A waterproof connection structure comprising:

a plurality of connection terminals that are arranged in parallel in a width direction and connect a plurality of flat conductors of a flat cable formed by sandwiching the flat conductors in a sheet-like insulating covering, the flat conductor being arranged in parallel in the width direction, and conductors of a plurality of insulated wires each obtained by covering one of the conductors with an insulating covering;

a partition member that includes:

a plurality of insulating rod-like portions to partition the connection terminals in an insulating manner, adjacent insulating rod-like portions being separated by a predetermined distance, and a link that links the rod-like portions together only at a first end side of the rod-like portions that receives the flat conductors, the link extending less than a full length of the rod-like portions and being substantially half of a height of the rod-like portions; and a waterproof covering member that integrally covers the plurality of connection terminals partitioned by the partition member and the partition member, and has waterproofing properties, insulating properties, and stretching properties.

14. A partition member partitioning connection terminals in an insulating manner being disposed between a plurality of connection terminals that are arranged in parallel in a width direction and connect a plurality of flat conductors of a flat cable formed by sandwiching the flat conductors in a sheet-like insulating covering, the flat conductor being arranged in parallel in the width direction, and conductors of a plurality of insulated wires obtained by covering one of the conductors with an insulating covering, the partition member comprising:

a plurality of insulating rod-like portions to partition the connection terminals, each of the rod-like portions having a rod shape and insulating properties, adjacent rod-like portions being separated by a predetermined distance;

outer frame portions disposed on outer sides of the plurality of rod-like portions arranged in parallel; and a link that links the rod-like portions and the outer frame portions only on a first end side that receives the flat conductors, the link extending less than a full length of the rod-like portions and being substantially half of a height of the rod-like portions.

* * * * *